United States Patent [19]

Bristow et al.

[11] 4,298,315

[45] Nov. 3, 1981

[54] POSITIVE DISPLACEMENT PUMP SYSTEMS

[75] Inventors: Ian T. Bristow, Higham; Nigel J. Petts, Rochester, both of England

[73] Assignee: Hobourn-Eaton Limited, Rochester, England

[21] Appl. No.: 101,789

[22] Filed: Dec. 10, 1979

[30] Foreign Application Priority Data

Dec. 13, 1978 [GB] United Kingdom ..... 48270/78

[51] Int. Cl.[3] ..... F04B 49/00

[52] U.S. Cl. ..... 417/300; 417/302; 417/304

[58] Field of Search ..... 417/286, 288, 300, 302, 417/304, 308

[56] References Cited

U.S. PATENT DOCUMENTS

| | | | |
|---|---|---|---|
| 2,755,741 | 7/1956 | Erskine | 417/304 X |
| 3,384,020 | 5/1968 | Searle | 417/300 |
| 3,985,472 | 10/1976 | Virtue et al. | 417/286 X |
| 4,002,027 | 1/1977 | Eley et al. | 417/286 X |

*Primary Examiner*—Richard E. Gluck

*Attorney, Agent, or Firm*—Wenderoth, Lind & Ponack

[57] ABSTRACT

A positive displacement pump system provides first and second delivery 11, 12 passages of which the first passage 11 communicates with a main discharge passage 15 containing a discharge orifice 17. The second delivery passage 12 opens to a valve bore and is in permanently open communication with the first delivery passage through an axial passage 29 in a valve member 20 slidably mounted in the valve bore. Lifting of the valve member with increasing pressure drop across the orifice 17 places the first delivery passage in communication with an overspill port 14. The pressure at the upstream and downstream sides of the orifice are applied against the lower end and the upper end 28 of the valve member so that the valve operates to maintain the pressure difference constant. The pressure difference between passage 29 and that applied against the upper end 28 of the valve member is therefore also substantially constant, so that leakage from passage 29 past the upper end 28 is constant. A variable effect does not have to be allowed for, therefore, and manufacturing tolerances can be widened.

2 Claims, 2 Drawing Figures

POSITIVE DISPLACEMENT PUMP SYSTEMS

This invention relates to positive displacement pump systems and more particularly to such pump systems providing two delivery passages for the pumped fluid, and a valve for maintaining the output of the pump system to an external circuit substantially constant by passing a variable quanity of the delivered fluid to an overspill.

According to this invention there is provided a positive displacement pump system providing first and second delivery passages for pumped fluid, a main discharge passage, a restrictor in the main discharge passage, a permanently open connecting passage between the first delivery passage and the main discharge passage, a valve bore opening at one end to the connecting passage, the second delivery passage opening to the valve bore, an overspill port opening to the valve bore at a location which is axially between said one end and said delivery passage, a valve member mounted in said bore, a chamber at the other end of the valve bore which chamber communicates with the main discharge passage at a location downstream of the restrictor and is permanently closed off from the second delivery passage by the valve member, a duct extending through the valve member and opening permanently at its opposite ends to the second delivery passage and said one end of the valve bore, a spring in said chamber urging the valve member into a stop position in which the valve member blanks off communication between the connecting passage and the overspill port, the valve member being movable against the spring force to uncover the overspill port progressively to place the overspill port in communication with the connecting passage.

Figure 1:
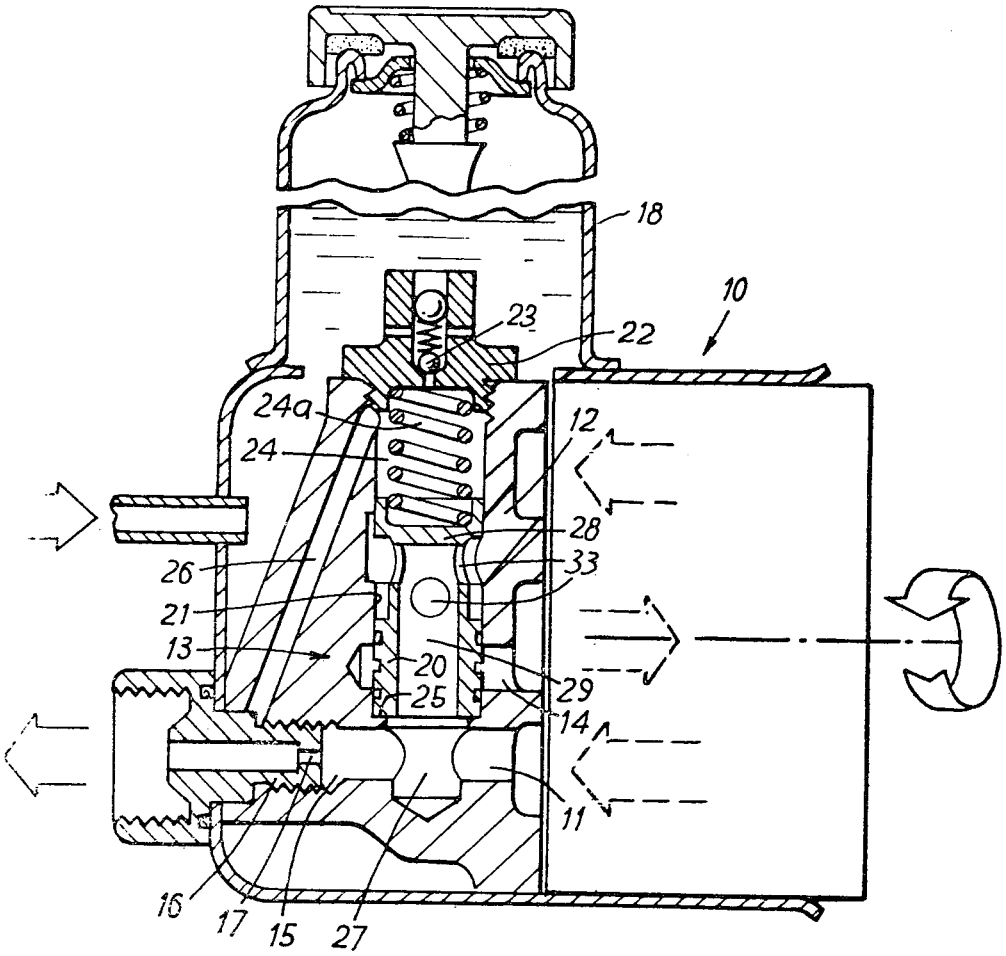
Figure 2:
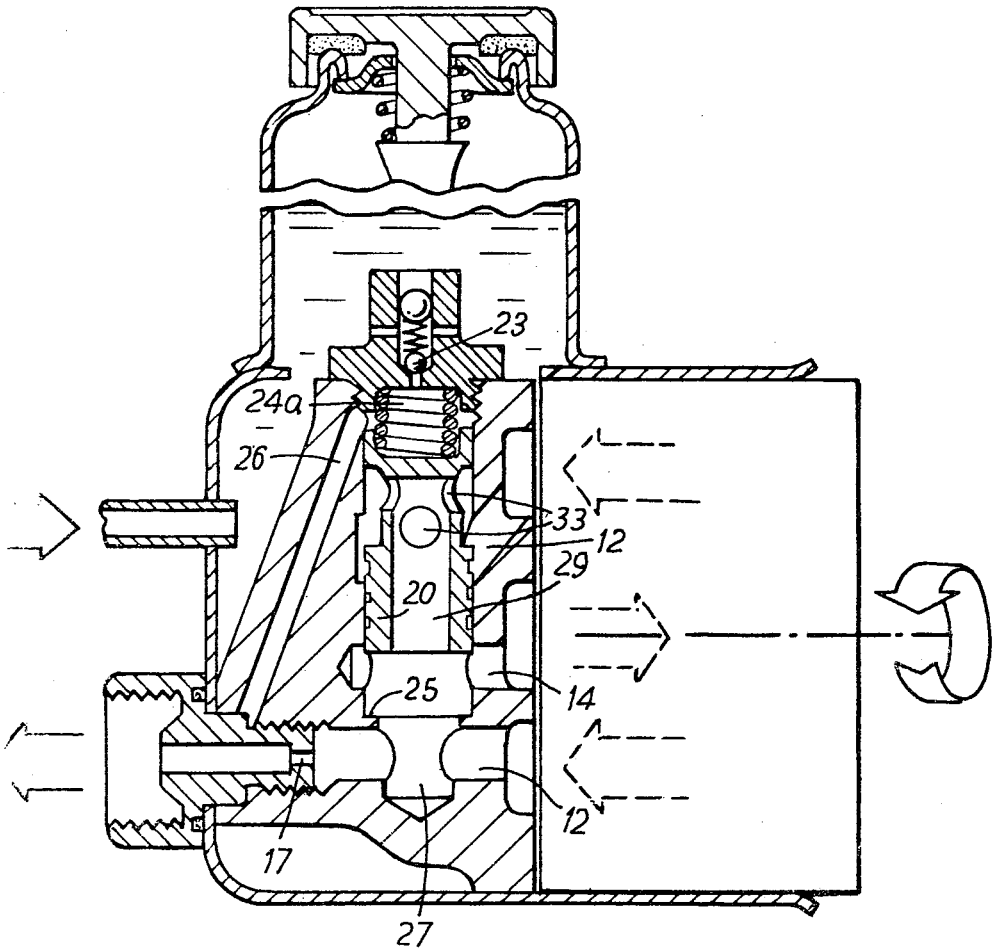

One embodiment of the invention will now be described with reference by way of example to the accompanying drawings in which FIGS. 1 and 2 show in diagrammatic elevation the control valve of a pump system according to the invention in its two extreme conditions of operation respectively.

Referring to FIG. 1 of the drawings, the pump system comprises a pump 10 which may for example be a vane type positive displacement pump in which the vanes carry out two pumping cycles in each revolution of the pump rotor, the pumped fluid from the two cycles being delivered to first and second delivery passages 11, 12 respectively, which are in communication with each other only under the control of a control valve 13. The combined flow from passages 11 and 12, less any which is surplus to the immediate requirements of the external circuit and which is directed to an overspill port 14 in the valve and thence to a fluid reservoir or the pump inlet for recirculation, is delivered to the external circuit through a main discharge passage 15 in which is mounted a screwed plug providing a discharge control orifice 17. The orifice is of accurately predetermined diameter according to the required fluid delivery, and the pressure drop across the orifice is applied to the valve 13 to maintain the flow through the orifice substantially constant. The valve 13 comprises a valve member 20 slidably mounted in a valve bore 21. The upper end of the valve bore has screwed into it a plug 22 carrying a spring-loaded ball relief valve 23 through which fluid under excess pressure in a chamber 24 formed at the upper end of the bore can be discharged into the encompassing fluid reservoir 18. Chamber 24 contains a spring 24*a* which urges the valve member 20 downward into abutment with an annular shoulder 25 at the other end of the valve bore. Chamber 24 communicates through a drilling 26 with the main discharge passage 15 at a location downstream of the orifice 17.

The lower end of the valve bore opens through an aperture bounded by the shoulder 25 to a chamber 27 which is formed by a smaller-diameter extension of the valve bore, and which places the first delivery passage 11 in permanently open communication with the main discharge passage 15. The pressure at the upstream side of the orifice 17 is thus applied in chamber 27 to the lower end of the valve member.

The upper end portion 28 of the valve member blocks off communication between the second delivery passage 12 and the spring chamber 24. From below the portion 28 the valve member has a central axial bore 29 the lower end of which opens to the bore extension 27. The upper end of the bore 29 is in permanently open communication with the second delivery passage 12 through two cross-bores 33 in a length of the valve member in which its external diameter is reduced.

At low pump speeds the flow from the second delivery passage 12 flows through the cross-bores 33 into the axial bore 29 and joins the flow from the first delivery passage into the main discharge passage, the valve member being held against the shoulder 25 by the spring 24*a*. As the pump speed increases, the pressure drop across the control orifice 17 increases until it reaches a value at which the valve member is moved against spring 24*a* sufficiently for the lower edge of the valve member to uncover the overspill port 14 so that as the pump speed continues to increase an increasing proportion of the combined delivery from passages 11 and 12 passes through the overspill port. If the pressure at the downstream side of the orifice 17 reaches a predetermined maximum value, the pilot ball relief valve 23 is opened, the pressure in the spring chamber 24 drops sharply and causes the valve member to move sharply against the force of spring 24*a* to cause a substantial increase in the amount of the fluid passing through the overspill port 14.

Owing to the unrestricted nature of the cross-bores 33 and axial bore 29 in the valve member the pressure of the fluid in the cross-bores and at port 12 is substantially equal to the pressure at the upstream side of the orifice 17 and in consequence the pressure difference between the fluid in the cross-bores and the fluid in the spring chamber 24 is equal to the pressure drop across the orifice 17. This pressure drop increases to a small extent with increasing pump delivery but is for practical purposes constant, with the result that the leakage into the spring chamber past the upper end portion of the valve member is relatively low and is in any event substantially constant. Its value is thus of lesser importance than if it varied appreciably because its effect can be countered if necessary by an adjustment in the force exerted by spring 24*a*. The manufacturing tolerances of the diameters of the valve bore and valve member can thus be widened without incurring any substantial penalty, with a consequent reduction in manufacturing cost.

We claim:

1. A positive displacement pump system providing first and second delivery passages for pumped fluid, a main discharge passage, a restrictor in the main discharge passage, a permanently open connecting passage between the first delivery passage and the main discharge passage, a valve bore opening at one end to the connecting passage, the second delivery passage opening to the valve bore, an overspill port opening to the valve bore at a location which is axially between said one end and said second delivery passage, a valve member mounted in said bore, a chamber at the other end of the valve bore which chamber communicates with the main discharge passage at a location downstream of the restrictor and is permanently closed off from the second delivery passage by the valve member, a duct extending through the valve member and opening permanently at its opposite ends to the second delivery passage and said one end of the valve bore, a spring in said chamber urging the valve member into a stop position in which the valve member blanks off communication between the connecting passage and the overspill port, the valve member being movable against the spring force to uncover the overspill port progressively to place the overspill port in communication with the connecting passage.

2. A positive displacement pump system as claimed in claim 1, further comprising a relief valve serving to relieve excess pressure in said chamber.

* * * * *